US010633883B2

(12) United States Patent
Zhu

(10) Patent No.: US 10,633,883 B2
(45) Date of Patent: Apr. 28, 2020

(54) LIGHTING SYSTEM FOR A PORTABLE SHELTER

(71) Applicant: Sunjoy Industries Group Ltd., Steubenville, OH (US)

(72) Inventor: Qi Zhu, Jiaxing (CN)

(73) Assignee: Sunjoy Industries Group Ltd., Steubenville, OH (US)

( * ) Notice: Subject to any disclaimer, the term of this patent is extended or adjusted under 35 U.S.C. 154(b) by 0 days.

(21) Appl. No.: 15/969,710

(22) Filed: May 2, 2018

(65) Prior Publication Data

US 2019/0338550 A1 Nov. 7, 2019

(51) Int. Cl.

| | |
|---|---|
| ***F21V 21/08*** | (2006.01) |
| ***E04H 15/10*** | (2006.01) |
| ***F21V 15/015*** | (2006.01) |
| ***F21V 23/06*** | (2006.01) |
| ***F21V 21/088*** | (2006.01) |
| ***F21V 23/00*** | (2015.01) |
| ***F21V 23/04*** | (2006.01) |
| ***F21S 9/02*** | (2006.01) |
| *F21W 131/10* | (2006.01) |
| *F21Y 115/10* | (2016.01) |

(52) U.S. Cl.

CPC ..... *E04H 15/10* (2013.01); *F21S 9/02* (2013.01); *F21V 15/015* (2013.01); *F21V 21/088* (2013.01); *F21V 21/0816* (2013.01); *F21V 23/001* (2013.01); *F21V 23/007* (2013.01); *F21V 23/04* (2013.01); *F21V 23/06* (2013.01); *F21W 2131/10* (2013.01); *F21Y 2115/10* (2016.08)

(58) Field of Classification Search

CPC .. F21V 15/015; F21V 21/088; F21V 21/0816; F21V 23/001; F21V 23/007; F21V 23/04; F21S 9/02; E04H 15/10

See application file for complete search history.

(56) References Cited

U.S. PATENT DOCUMENTS

| | | | | |
|---|---|---|---|---|
| 9,107,493 | B2 | 8/2015 | Pan et al. | |
| 9,243,422 | B2 | 1/2016 | Hunt et al. | |
| 9,556,639 | B2 | 1/2017 | Hunt et al. | |
| 2007/0295377 | A1* | 12/2007 | Holub | E04H 15/18 135/91 |
| 2017/0292285 | A1* | 10/2017 | Jin | F21V 23/04 |

* cited by examiner

*Primary Examiner* — Anne M Hines

(74) *Attorney, Agent, or Firm* — The Law Office of Patrick F. O'Reilly, III, LLC

(57) ABSTRACT

A lighting system for a portable shelter is disclosed herein. The lighting system includes at least one light bar, the at least one light bar including a plurality of spaced-apart lights, the at least one light bar configured to be attached to one or more frame members of a portable shelter; and a power module unit, the power module unit configured to be electrically coupled to the at least one light bar so as to provide power to the plurality of spaced-apart lights. In one or more embodiments, the lighting system may further include one or more fastener devices for attaching the at least one light bar to one or more frame members of a portable shelter, and at least one wire connector device for electrically coupling the at least one light bar to the power module unit.

18 Claims, 7 Drawing Sheets

Detail "B"

Detail "A"

Sectional A-A

LIGHTING SYSTEM FOR A PORTABLE SHELTER

CROSS-REFERENCE TO RELATED APPLICATIONS

Not Applicable.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a lighting system for a portable shelter. More particularly, the invention relates to a lighting system for illuminating the interior of a portable shelter.

2. Background

Portable outdoor shelters, such as portable outdoor gazebos, are useful for a myriad of different applications. For example, gazebos are often used for backyard patio gathering spaces. Because the gazebos are at least partially enclosed, table and chair sets may be arranged underneath the gazebos so that the individuals seated around the table may remain cooler by being shaded from direct sunlight. Also, when food is being served outside, a food serving table or tables are often placed underneath the gazebo to protect the food from direct sunlight and rain.

Although, particularly at night, the interior of a conventional portable shelter, such as a portable outdoor gazebo, is often dark because there is not a light source present inside the shelter. In some cases, a user may illuminate at least a portion of the interior of the portable shelter using a portable light source, such as a lamp or flashlight. However, portable light sources, such as lamps and flashlights, provide less than ideal light to the interior of the portable shelter because the light produced by these portable light sources is typically not distributed evenly throughout the interior of the portable shelter.

Therefore, what is needed is a lighting system for a portable shelter that is designed to illuminate the interior of a portable shelter so as to obviate the need for other light sources, such as lamps and flashlights. Moreover, a lighting system for a portable shelter is needed that is capable of providing distributed light within the interior of a portable shelter. Furthermore, a lighting system for a portable shelter is needed that is configured to attach to one or more frame members of a portable shelter so that the lighting system can be conveniently supported using the frame of the portable shelter.

BRIEF SUMMARY OF EMBODIMENTS OF THE INVENTION

Accordingly, the present invention is directed to a lighting system for a portable shelter that substantially obviates one or more problems resulting from the limitations and deficiencies of the related art.

In accordance with one or more embodiments of the present invention, there is provided a lighting system for a portable shelter that includes at least one light bar, the at least one light bar including a plurality of spaced-apart lights, the at least one light bar configured to be attached to one or more frame members of a portable shelter; and a power module unit, the power module unit configured to be electrically coupled to the at least one light bar so as to provide power to the plurality of spaced-apart lights.

In a further embodiment of the present invention, at least one of the spaced-apart lights is in the form of a light-emitting diode.

In yet a further embodiment, the at least one light bar further comprises a light lens covering the light-emitting diode.

In still a further embodiment, the at least one light bar further comprises a housing portion and a light strip disposed within an interior cavity of the housing portion, the light strip including the plurality of spaced-apart lights.

In yet a further embodiment, the housing portion of the at least one light bar comprises one or more slots disposed through opposite sides of the housing portion for accommodating a fastener device that attaches the at least one light bar to the one or more frame members of the portable shelter.

In still a further embodiment, the housing portion of the at least one light bar comprises a first end cap and a second end cap, the first end cap being disposed at a first longitudinal end of the at least one light bar, and the second end cap being disposed at a second longitudinal end of the at least one light bar that is opposite to the first longitudinal end.

In yet a further embodiment, the first end cap of the housing portion of the at least one light bar has a solid end wall, and the second end cap of the housing portion of the at least one light bar has a female electrical connector disposed therein for electrically coupling the at least one light bar to the power module unit.

In still a further embodiment, the lighting system further comprises one or more fastener devices for attaching the at least one light bar to the one or more frame members of the portable shelter.

In yet a further embodiment, at least one of the one or more fastener devices comprises a strap member and a hook member, the strap member configured to engage with the hook member so as to attach the at least one light bar to the one or more frame members of the portable shelter.

In still a further embodiment, at least one of the one or more fastener devices comprises a mounting clip with first and second prong members, the first and second prong members of the mounting clip configured to engage the one or more frame members of the portable shelter.

In yet a further embodiment, the power module unit comprises a first housing portion, a second housing portion, and a battery compartment configured to hold one or more batteries for powering the plurality of spaced-apart lights, the battery compartment being disposed in the second housing portion.

In still a further embodiment, the power module unit further comprises a control board for regulating the power supplied to the plurality of spaced-apart lights by the one or more batteries, the control board being enclosed by the first and second housing portions.

In yet a further embodiment, the lighting system further comprises at least one wire connector device for electrically coupling the at least one light bar to the power module unit.

In still a further embodiment, the at least one wire connector device comprises a first end portion, a second end portion, and a central wire portion disposed between the first end portion and the second end portion. In this further embodiment, the first end portion of the at least one wire connector device is sliding disposed within the power module unit so as to allow the at least one light bar to be adjustably positioned relative to the power module unit.

In yet a further embodiment, the second end portion of the at least one wire connector device comprises a male electrical connector configured to engage with a female electrical connector disposed on an end of the at least one light bar.

In still a further embodiment, the second end portion of the at least one wire connector device comprises a slot disposed therethrough for accommodating a fastener device that attaches the at least one light bar to the one or more frame members of the portable shelter.

In accordance with one or more other embodiments of the present invention, there is provided a lighting system for a portable shelter that includes at least one light bar, the at least one light bar including a plurality of spaced-apart lights; one or more fastener devices for attaching the at least one light bar to one or more frame members of a portable shelter; a power module unit, the power module unit configured to provide power to the plurality of spaced-apart lights; and at least one wire connector device for electrically coupling the at least one light bar to the power module unit.

In a further embodiment of the present invention, the at least one light bar comprises a plurality of light bars, and the power module unit is configured to be centrally disposed relative to the plurality of light bars.

In yet a further embodiment, the at least one wire connector device comprises a plurality of wire connector devices, and each of the plurality of light bars is configured to be electrically coupled to the power module unit by a respective one of the plurality of wire connector devices, and each of the plurality of wire connector devices is slidably coupled to the power module unit so as to allow the at least one light bar to be adjustably positioned relative to the power module unit.

In still a further embodiment, the at least one wire connector device removably couples the at least one light bar to the power module unit by means of a disengageable electrical connector.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
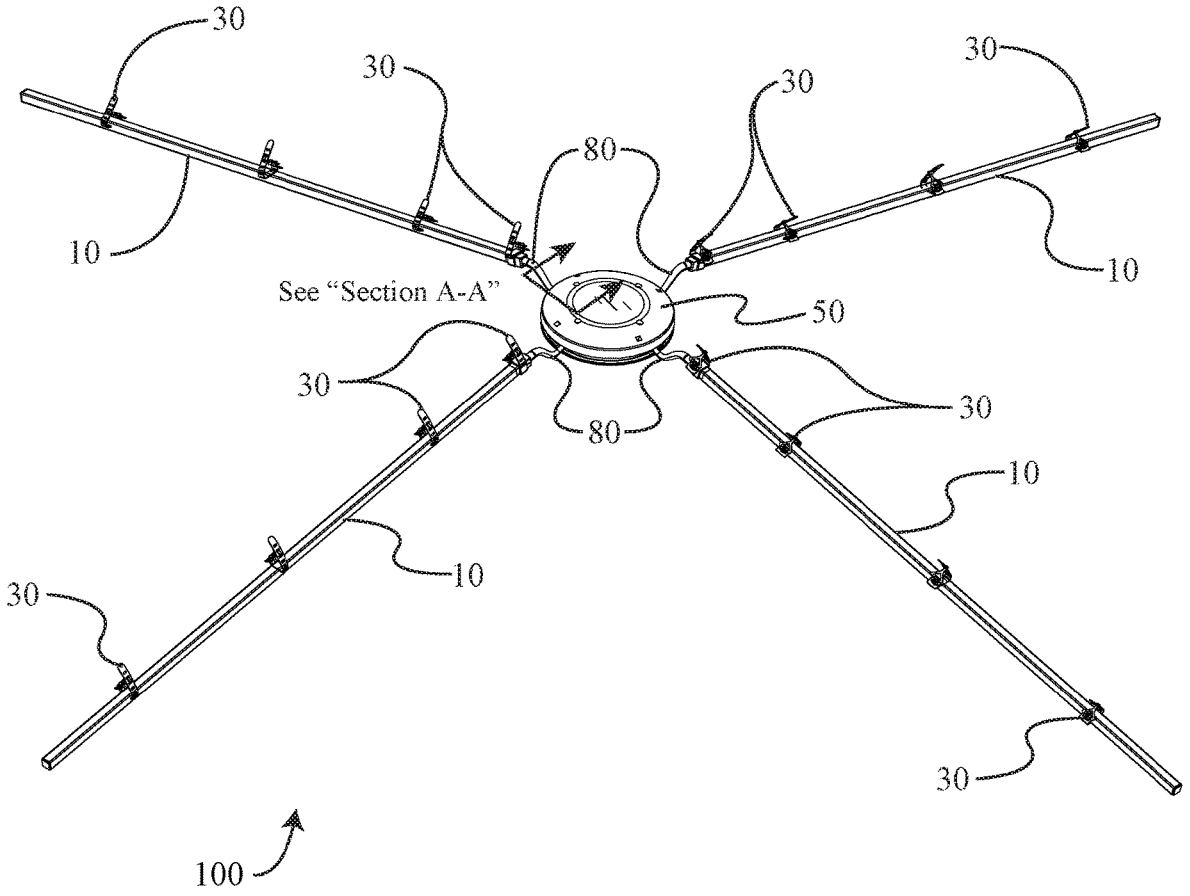
FIG. 1 is a perspective view of a lighting system for a portable shelter, according to an illustrative embodiment of the invention.
Figure 2:
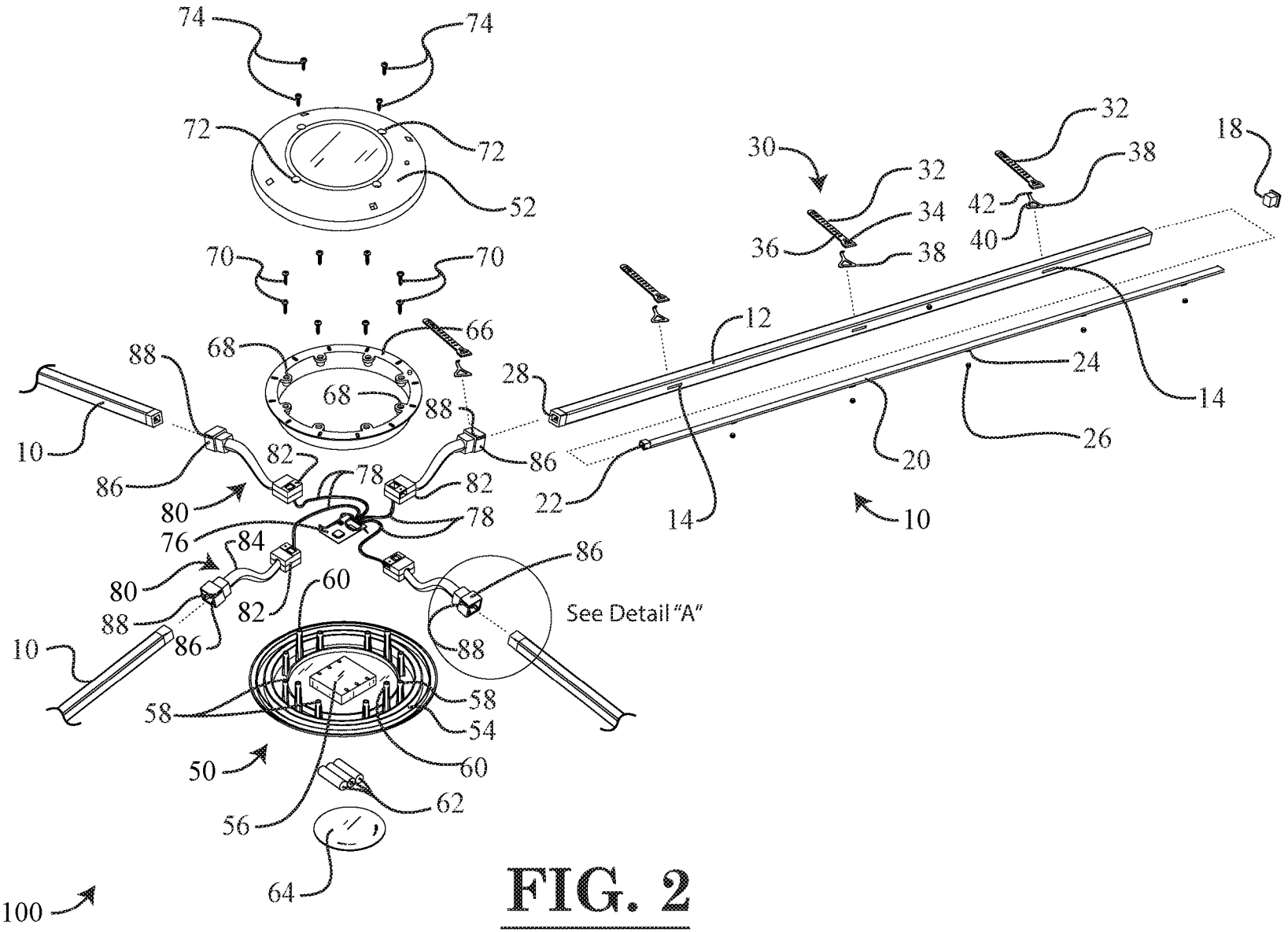
FIG. 2 is an exploded perspective view of the portable shelter lighting system of FIG. 1.
Figure 3:
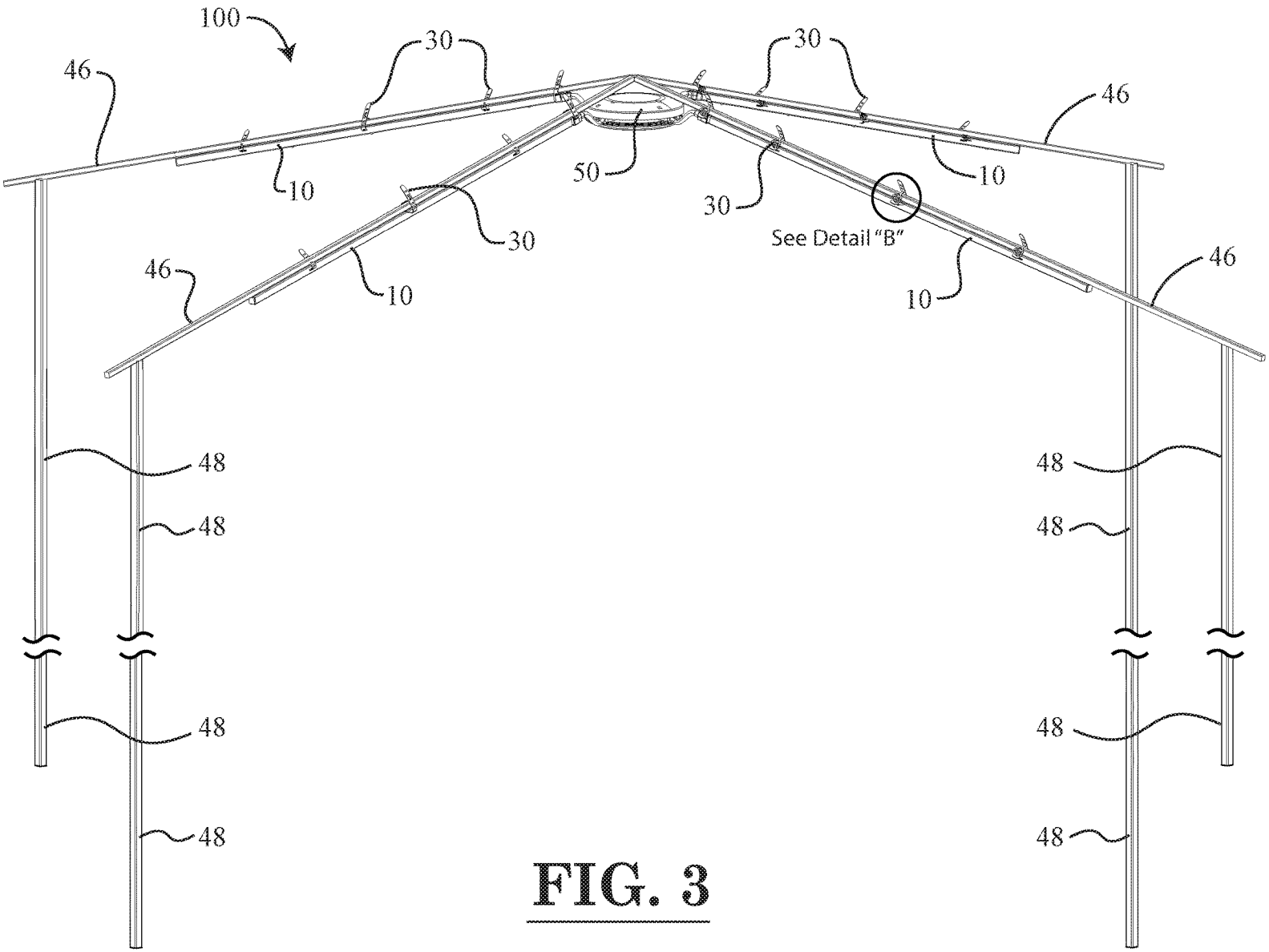
FIG. 3 is another perspective view of the portable shelter lighting system of FIG. 1, wherein the portable shelter lighting system is mounted to the roof frame members of a portable shelter.

An illustrative embodiment of a portable shelter lighting system is seen generally at 100 in FIGS. 1-3. In particular, referring initially to the perspective views of FIGS. 1-3, it can be seen that the illustrative portable shelter lighting system 100 generally comprises a plurality of light bars 10, each of the light bars 10 including a plurality of spaced-apart lights 24 (see FIG. 2); a plurality of fastener devices 30 for attaching the light bars 10 to respective frame members 46 of a portable shelter (e.g., gazebo—see FIG. 3); a power module unit 50, the power module unit 50 configured to provide power to the plurality of spaced-apart lights 24; and a plurality of wire connector devices 80 for electrically coupling the light bars 10 to the power module unit 50. In addition, as will be described hereinafter, the illustrative portable shelter lighting system 100 may further comprise a power switch module 94 (see FIG. 10) so as to allow a user to selectively activate and deactivate the lights 24 of the lighting system 100.

As shown in FIG. 3, the portable shelter lighting system 100 may be mounted to the roof frame members 46 of a portable shelter frame structure (e.g., the roof frame members 46 of a gazebo). In FIG. 3, it can be seen that each of the diagonally-oriented roof frame members 46 is supported on a respective vertical frame member 48, which operates as a corner support post of the portable shelter. While a gazebo frame structure is depicted in the illustrative embodiment of FIG. 3, it is to be understood that the portable shelter lighting system 100 described herein may be mounted to a myriad of different outdoor shelters, such as gazebos, pergolas, and other types of outdoor structures that are portable, semi-permanent, and permanent. Also, as will be described in further detail hereinafter, the light bars 10 advantageously are adjustably connected to the power module unit 50 (see FIG. 6) so as to allow the lighting system 100 to be used with many different shelter frame configurations.

Figure 7:
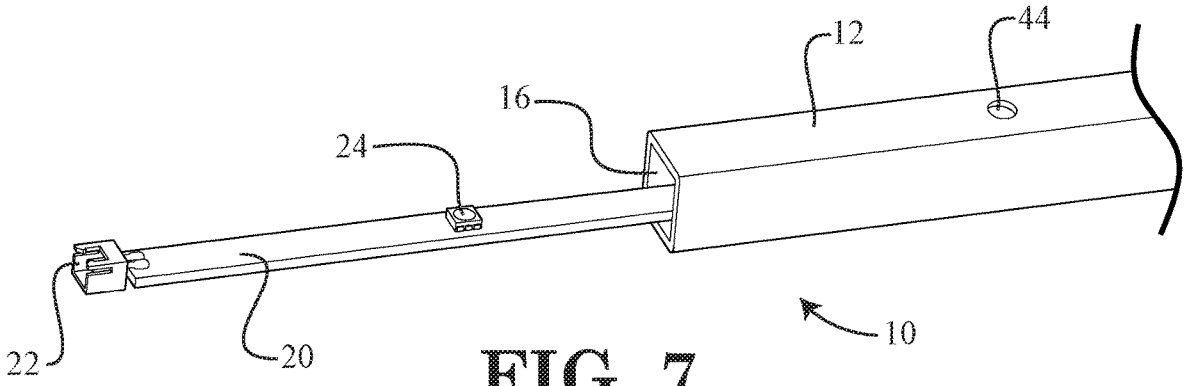
FIG. 7 is an enlarged, partial perspective view illustrating a light plate of one of the light bars of the portable shelter lighting system of FIG. 1, wherein the light plate is shown partially removed from the interior of the light bar housing so as to better illustrate features of the light plate.
Figure 8:
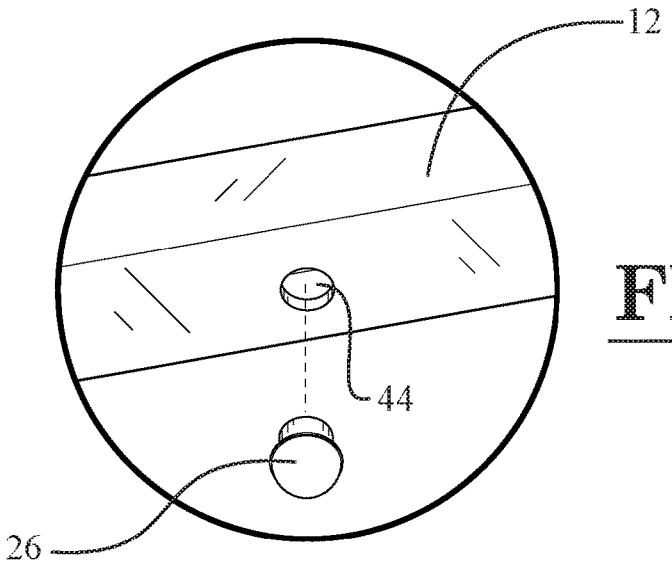
FIG. 8 is an enlarged, partial perspective view illustrating a light lens of one of the light bars of the portable shelter lighting system of FIG. 1, wherein the light lens is shown removed from the light bar housing so as to more clearly illustrate the light lens.

Now, with combined reference to FIGS. 1, 2, 7, and 8, the light bars 10 of the illustrative portable shelter lighting system 100 will be described. In the illustrative embodiment, each of the light bars includes a housing portion 12 and a light strip or light plate 20 disposed within an interior cavity 16 of the housing portion 12 (see FIG. 7). As best shown in the exploded view of FIG. 2, the light strip includes a plurality of spaced-apart lights 24. In the illustrative embodiment, the spaced-apart lights 24 of the light strip 20 are in the form of light-emitting diode (LED) lights. Although, in other embodiments, other suitable types of lights may also be used on the light strip 20. In FIG. 8, it can be seen that, in the illustrative embodiment, each of the spaced-apart lights 24 is provided with a light lens 26 covering the LED light 24. In particular, as shown in FIG. 8, each light lens 26 fits within a respective lens aperture 44 disposed in the sidewall of the tubular housing 12 of the light bar 10. The light lens 26 protects the LED light 24, and helps to properly diffuse the light into the interior of the portable shelter. Also, as shown in FIGS. 2 and 7, the proximal end of each light strip 20 (i.e., the end of the light strip 20 closest to the power module unit 50) comprises a female electrical connector 22 that engages with the male electrical connector 90 of a respective wire connector device 80, as will be described in further detail hereinafter.

Figure 5:
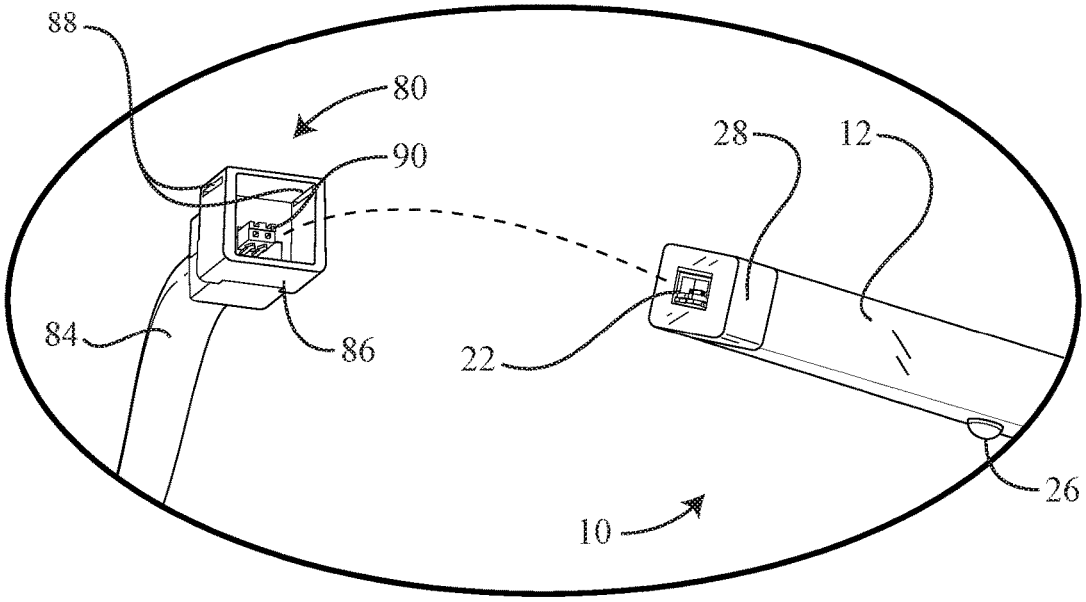
FIG. 5 is an enlarged, partial perspective view illustrating one of the light bars of the portable shelter lighting system of FIG. 1 shown being attached to one of the wire connector devices of the lighting system (Detail "A")

Referring to the illustrative embodiment of FIGS. 2 and 5, it can be seen that the housing portion 12 of each light bar 10 comprises a first end cap 18 and a second end cap 28. The first end cap 18 is disposed at a first longitudinal end of the light bar 10 (i.e., the distal end of the light bar 10), and the second end cap 28 is disposed at a second longitudinal end of the light bar 10 (i.e., the proximal end of the light bar 10) that is opposite to the first longitudinal end. As shown in FIG. 2, the first end cap 18 of the housing portion 12 of the light bar 10 has a solid end wall, and the second end cap 28 of the housing portion 12 of the light bar 10 has the female electrical connector 22 of the light strip 20 disposed therein for electrically coupling the light bar 10 to the power module unit 50. Turning again to FIG. 2, it can be seen that the housing portion 12 of each light bar 10 comprises a plurality of slots 14 disposed through opposite sides of the housing portion 12 for accommodating respective fastener devices 30 that attach the light bar 10 to a respective roof frame member 46 of the portable shelter.

Figure 4:
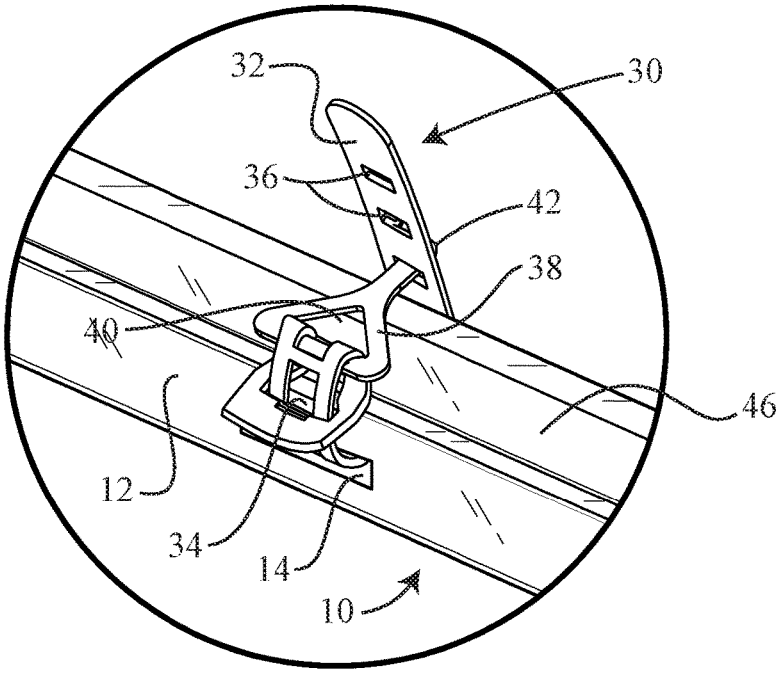
FIG. 4 is an enlarged, partial perspective view illustrating one of the fastener devices of the portable shelter lighting system of FIG. 1 shown attached to one of the roof frame members in FIG. 3 (Detail "B")

Next, referring collectively to FIGS. 2 and 4, the fastener devices 30 of the portable shelter lighting system 100 will be explained. In the illustrative embodiment, as shown in FIGS. 2 and 4, each of the fastener devices 30 comprises a strap member 32 and a hook member 38. In the illustrative embodiment, the strap member 32 is in the form of a strap tie with a plurality of elongate slots 36 spaced apart on the body of the strap member 32. The strap member 32 additionally comprises a keyhole-shaped end aperture 34 disposed through a first end portion of the strap tie body for receiving a looped portion of the strap tie passing therethrough (refer to FIG. 4). In the illustrative embodiment, the hook member 38 comprises a triangular aperture 40 disposed in a first end portion thereof and a hook-shaped second end portion 42 disposed opposite to the first end portion (see FIG. 2). As shown in the detail view of FIG. 4, the strap member 32 engages with the hook member 38 so as to attach the light bar 10 to the roof frame member 46 of the portable shelter. More specifically, the first end portion of the strap member 32 is wrapped around itself such that the strap first passes through the triangular aperture 40 of the hook member 38, and then through the keyhole-shaped aperture 34 of the strap member 32. As such, the first end portion of the strap member 32 forms a loop so as to engage the first end of the hook member 38. In FIG. 4, it can then be seen that the strap member 32 passes through the pair of slots 14 disposed through opposite sides of the light bar housing portion 12. Finally, as shown in FIG. 4, the hook-shaped second end portion 42 of the hook member 38 engages with a selected one of the elongate slots 36 disposed in the strap member 32 so as to attach the light bar 10 to the frame member 46. Advantageously, the plurality of slots 36 in the strap member 32 allow the fastener device 30 to accommodate frame members having a plurality of different cross-sectional sizes. In the illustrative embodiment, each of the strap members 32 may be formed from a flexible plastic material, while each of the hook members 38 may be formed from a suitable metallic material. In other embodiments, other suitable materials may be used for the strap members 32 and the hook members 38.

Figure 10:
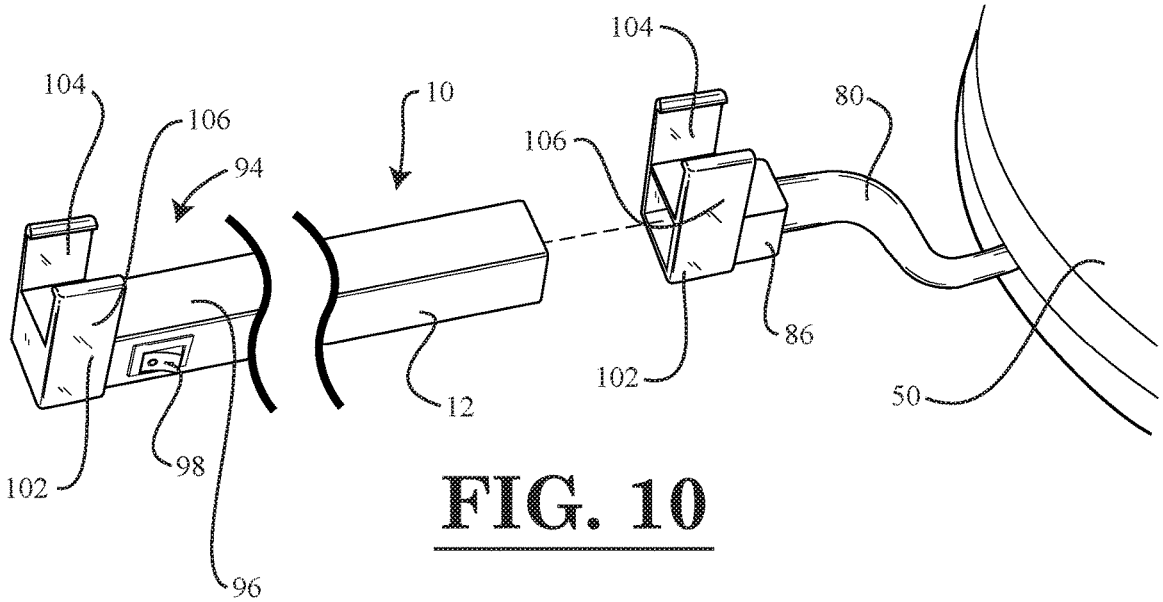
FIG. 10 is a partial perspective view illustrating a power switch module and alternative fastener devices that can be used with the portable shelter lighting system of FIG. 1.
Figure 11:
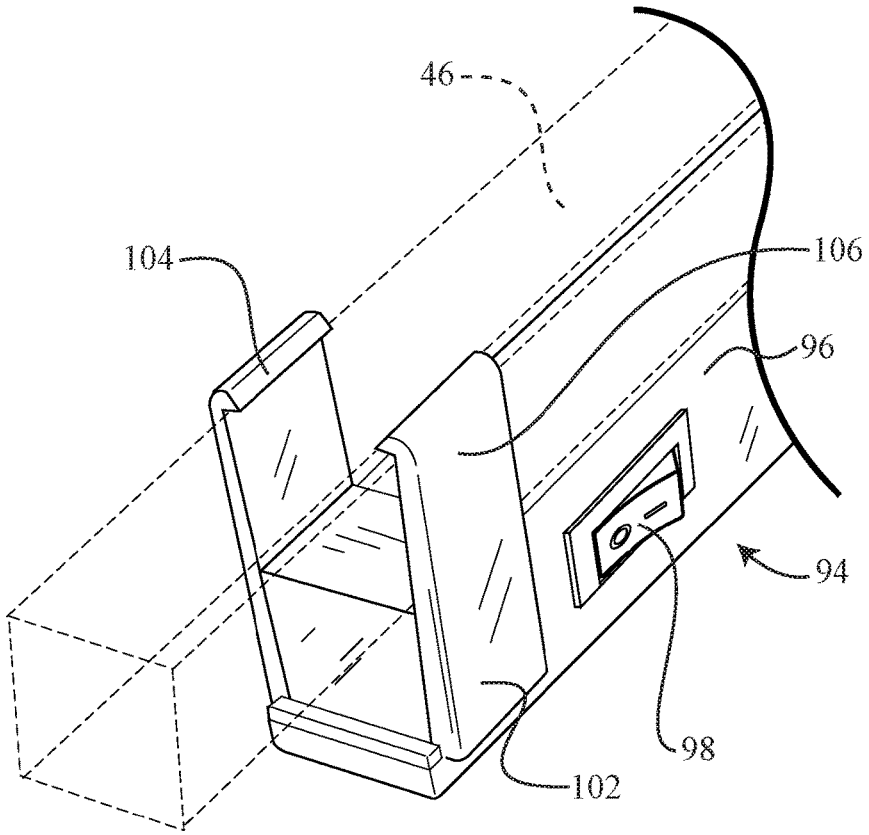
FIG. 11 is an enlarged, partial perspective view illustrating an end portion of the power switch module of FIG. 10 with the fastener device at the end of the power switch module shown being attached to a roof frame member of a portable shelter.

Turning now to FIGS. 10 and 11, in the illustrative embodiment, the portable shelter lighting system 100 may further include a power switch module 94 for allowing a user to selectively activate and deactivate the lights 24 of the lighting system 100. The power switch module 94 may be electrically coupled to one of the light bars 10 of the lighting system 100. More specifically, in the illustrative embodiment, the power switch module 94 may be coupled to one of the distal ends of the light bars 10 such that the power switch 98 of the power switch module 94 may be more easily reached by the user of the lighting system 100 (i.e., because the roof frame members 46 slope upwardly toward the center of the gazebo in a typical installation, see e.g., FIG. 3, the distal ends of the light bars 10 are at the lowest part of the gazebo ceiling, while the proximal ends of the light bars 10 are at the highest central part of the gazebo ceiling). In the illustrative embodiment, as shown in FIGS. 10 and 11, the power switch module 94 comprises a tubular housing portion 96 with the "On"/"Off" power switch 98 disposed on a side of the tubular housing 96. In the illustrative embodiment, the power switch 98 may comprise a rocker-type power switch.

Referring again to FIGS. 10 and 11, an alternative type of fastener device 102 for attaching the light bars 10 to respective frame members 46 of a portable shelter (e.g., gazebo) is shown. As shown in these figures, the alternative type of fastener device 102 is in the form of a mounting clip that comprises first and second resilient prong members 104, 106. The first prong member 104 is oppositely disposed relative to the second prong member 106. Each of the first and second prong members 104, 106 comprises a projecting distal end that snaps into place at the top of the roof frame member 46 so as to attach the light bar 10 to the frame member 46. When each mounting clip 102 is first pressed onto the roof frame member 46, the resilient prong members 104, 106 deform outwardly so as to allow the frame member 46 to be inserted into the central cavity of the clip 102. Then, once the frame member 46 has been fully inserted into the central cavity of the clip 102, the resilient prong members 104, 106 snap back into positions at least substantially equivalent to the undeformed positions thereof such that projecting distal ends of each of the prong members 104, 106 secures the clip 102 in place on the frame member 46. In the illustrative embodiment, each of the mounting clips 102 may be formed from a resilient material, such as a suitable elastically deformable polymeric material or plastic.

Now, with combined reference to FIGS. 1, 2, 6, and 9, the power module unit 50 of the illustrative portable shelter lighting system 100 will be described. In the illustrative embodiment, the power module unit 50 is in form of a central power and control unit with a first top housing portion 52, a second bottom housing portion 54, and a battery compartment 56 configured to hold a plurality of batteries 62 for powering the plurality of spaced-apart lights 24 on the light bars 10 (refer to FIG. 2). As shown in the exploded view of FIG. 2, the battery compartment 56 is disposed in the second bottom housing portion 54, and may be accessed from the bottom of the power module unit 50 by removing the circular battery cover plate 64 from the remainder of the housing. Also, as depicted in FIG. 2, the power module unit 50 further comprises a control board or printed circuit board (PCB) 76 for regulating the power supplied (i.e., by providing a stable voltage) to the plurality of spaced-apart lights 24 by the plurality of batteries 62. The control board 76 may also include interface electronics (e.g., a receiver) for allowing the lighting system 100 to be wirelessly coupled to a remote control (with a transmitter) for allowing the lights 24 to be turned on/off and/or dimmed without requiring a user to access the lighting system 100 at the ceiling of the portable shelter (e.g., gazebo). In the illustrative embodiment, the control board 76 is enclosed by the first and second housing portions 52, 54 of the power module unit 50.

In the illustrative embodiment, the plurality of batteries 62 powering the portable shelter lighting system 100 may comprise AA size batteries (e.g., four (4) AA size batteries). Although, in other embodiments, the lighting system 100 may be powered by another suitable size and quantity of batteries, or by a building power source.

Figure 9:
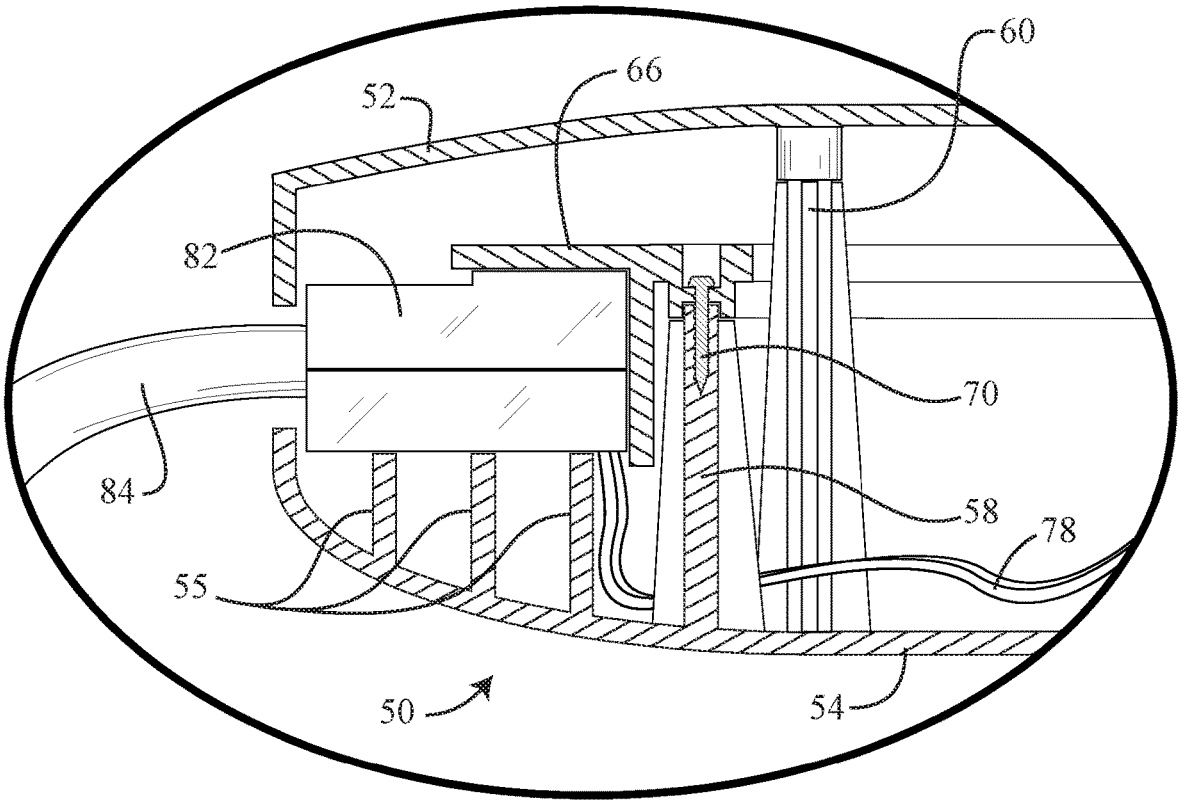
FIG. 9 is a sectional view of the central power and control unit of the portable shelter lighting system of FIG. 1, wherein the section is generally cut along the cutting-plane line A-A in FIG. 1.

Referring again to FIGS. 2 and 9, it can be seen that the bottom housing portion 54 of the power module unit 50 is provided with a first plurality of ring fastener bosses 58 and a second plurality of top housing fastener bosses 60 projecting upwardly from the floor of the bottom housing portion 54. The ring fastener bosses 58 are used to attach the securement ring 66 to the bottom housing portion 54. More particularly, as shown in FIG. 2, the securement ring 66 is provided with inwardly projecting tab members having respective fastener apertures 68 formed therein for receiving fasteners 70 (e.g., screws 70) that secure the securement ring 66 to the bottom housing portion 54. Each fastener 70 passes through a respective fastener aperture 68 in the securement ring 66, and threadingly engages with one of the internally-threaded bosses 58 to attach the securement ring 66 to bottom housing portion 54. The top housing fastener bosses 60 are used to attach the top housing portion 52 to the bottom housing portion 54. More particularly, as shown in FIG. 2, the top housing portion 52 is provided with a plurality of fastener apertures 72 formed therein for receiving fasteners 74 (e.g., screws 74) that secure the top housing portion 52 to the bottom housing portion 54. Each fastener 74 passes through a respective fastener aperture 72 in the top housing portion 52, and threadingly engages with one of the internally-threaded bosses 60 to attach the top housing portion 52 to bottom housing portion 54. Also, as shown in FIGS. 2 and 9, it can be seen that the floor of the bottom housing portion 54 further comprises a plurality of concentric rail members 55 for supporting the proximal end portions 82 of the wire connecting devices 80 that will be described hereinafter.

Figure 6:
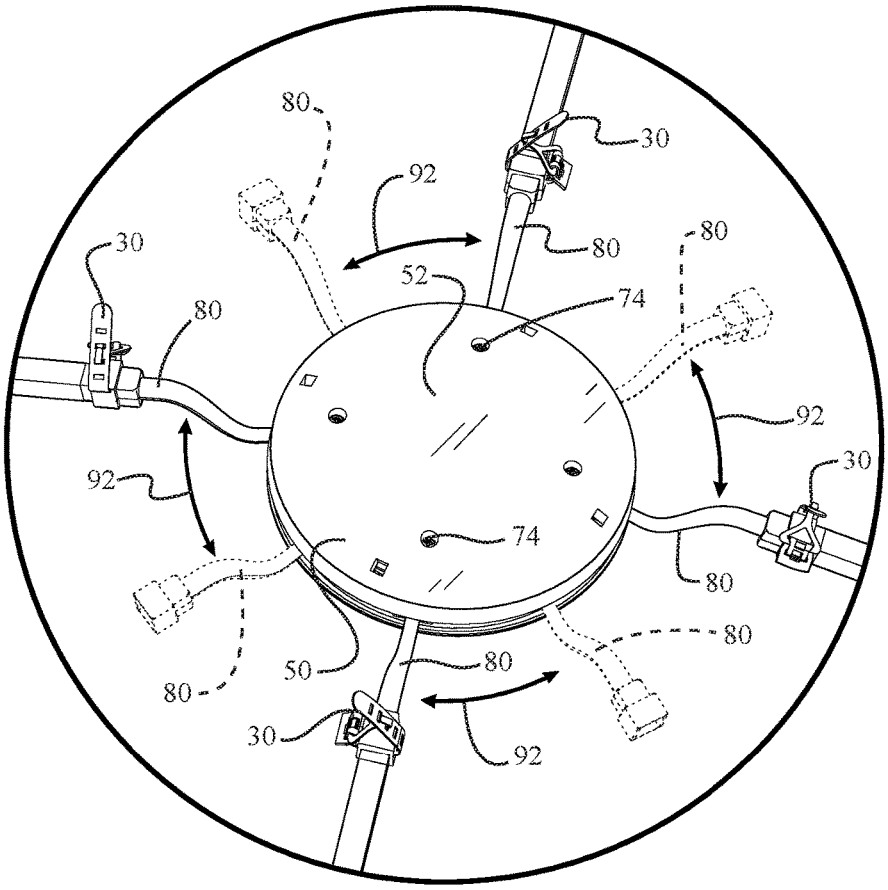
FIG. 6 is an enlarged, partial perspective view illustrating the adjustability of the wire connector devices of the portable shelter lighting system of FIG. 1 relative to the central power and control unit of the lighting system.

Next, referring collectively to FIGS. 2, 5, and 6, the wire connector devices 80 of the illustrative portable shelter lighting system 100 will be explained. In the illustrative embodiment, each of the wire connector devices 80 comprises a first end portion 82 (i.e., the proximal end portion 82 of the wire connector device 80), a second end portion 86 (i.e., the distal end portion 86 of the wire connector device 80), and a central wire portion 84 disposed between the first end portion 82 and the second end portion 86. Advantageously, as diagrammatically illustrated by the arrows 92 in FIG. 6, the first end portion 82 of each wire connector device 80 is sliding disposed within the power module unit 50 so as to allow the light bars 10 to be adjustably positioned relative to the power module unit 50 (i.e., the circumferential spacing of the wire connector devices 80 about the periphery of the central power module unit 50 can be adjusted to accommodate different arrangements of roof frame members 46 in different portable shelters, such as gazebos). Turning to the sectional view of FIG. 9, it can be seen that the proximal end portion 82 of each wire connector device 80 is held in place by the securement ring 66 of the power module unit 50. The movement of the proximal end portion 82 of each wire connector device 80 is constrained in the vertical direction by the rail members 55 and the securement ring 66, but the proximal end portion 82 of each wire connector device 80 is able to be rotated in a lateral direction so as to allow the position of the wire connector device 80 to be adjusted. While the proximal end portion 82 of each wire connector device 80 is being adjusted inside the power module unit 50, the proximal end portion 82 of each wire connector device 80 slides on top of the rail members 55 and beneath the securement ring 66. As shown in FIG. 2, the proximal end portion 82 of each wire connector device 80 is electrically coupled to the control board 76 in the power module unit 50 by a respective electrical wire 78.

As best shown in the detail view of FIG. 5, the second end portion 86 of each wire connector device 80 comprises a male electrical connector 90 that engages with the female electrical connector 22 that is disposed within the proximal end cap 28 of each light bar 10 so as to provide power to each light bar 10 from the power module unit 50. In the illustrative embodiment, each wire connector device 80 removably couples each light bar 10 to the power module unit 50 by means of a disengageable electrical connector (i.e., the male electrical connector 90 of the wire connector device 80 is disengageable from the female electrical connector 22 of the light bar 10). Also, in the illustrative embodiment, as shown in FIGS. 2 and 5, the second end portion 86 of each wire connector device 80 comprises oppositely-disposed slots 88 passing through the sides thereof for accommodating a strap member 32 of the fastener device 30 that attaches the light bar 10 to one of the roof frame members 46 of the portable shelter.

It is readily apparent that the aforedescribed portable shelter lighting system 100 offer numerous advantages. First, the portable shelter lighting system 100 is designed to illuminate the interior of a portable shelter, such as a gazebo, so as to obviate the need for other light sources, such as lamps and flashlights. Secondly, the portable shelter lighting system 100 is capable of providing distributed light within the interior of a portable shelter, such as a gazebo. Finally, the portable shelter lighting system 100 is configured to attach to one or more frame members of a portable shelter, such as a gazebo, so that the lighting system 100 can be conveniently supported using the frame 46 of the portable shelter.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A lighting system for a portable shelter, comprising:

at least one light bar, the at least one light bar including a plurality of spaced-apart lights, the at least one light bar configured to be attached to one or more frame members of a portable shelter;

a power module unit, the power module unit configured to be electrically coupled to the at least one light bar so as to provide power to the plurality of spaced-apart lights, the power module unit defining a peripheral wire connector cavity within an interior of the power module unit; and at least one wire connector device for electrically coupling the at least one light bar to the power module unit, the at least one wire connector device including a first end portion, the first end portion of the at least one wire connector device being circumferentially slidable within the peripheral wire connector cavity of the power module unit so as to allow the at least one light bar to be adjustably positioned relative to the power module unit;

wherein the power module unit comprises a first housing portion, a second housing portion, a securement ring, and a battery compartment configured to hold one or more batteries for powering the plurality of spaced-apart lights, the battery compartment being disposed in the second housing portion, and the second housing portion of the power module unit further comprising a plurality of concentric rail members for supporting the first end portion of the at least one wire connector device, the first end portion of the at least one wire connector device being slidably disposed between the securement ring and the plurality of concentric rail members within the power module unit.

2. The lighting system according to claim 1, wherein at least one of the spaced-apart lights is in the form of a light-emitting diode.

3. The lighting system according to claim 2, wherein the at least one light bar further comprises a light lens covering the light-emitting diode.

4. The lighting system according to claim 1, wherein the at least one light bar further comprises a housing portion and a light strip disposed within an interior cavity of the housing portion, the light strip including the plurality of spaced-apart lights.

5. The lighting system according to claim 4, wherein the housing portion of the at least one light bar comprises a first end cap and a second end cap, the first end cap being disposed at a first longitudinal end of the at least one light bar, and the second end cap being disposed at a second longitudinal end of the at least one light bar that is opposite to the first longitudinal end.

6. The lighting system according to claim 5, wherein the first end cap of the housing portion of the at least one light bar has a solid end wall, and wherein the second end cap of the housing portion of the at least one light bar has a female electrical connector disposed therein for electrically coupling the at least one light bar to the power module unit.

7. The lighting system according to claim 1, further comprising one or more fastener devices for attaching the at least one light bar to the one or more frame members of the portable shelter.

8. The lighting system according to claim 7, wherein at least one of the one or more fastener devices comprises a strap member and a hook member, the strap member configured to engage with the hook member so as to attach the at least one light bar to the one or more frame members of the portable shelter; and wherein the at least one light bar comprises a housing portion with slots disposed through opposite sides of the housing portion for accommodating the strap member that attaches the at least one light bar to the one or more frame members of the portable shelter.

9. The lighting system according to claim 7, wherein at least one of the one or more fastener devices comprises a mounting clip with first and second prong members, the first and second prong members of the mounting clip configured to engage the one or more frame members of the portable shelter.

10. The lighting system according to claim 1, wherein the power module unit further comprises a control board for regulating the power supplied to the plurality of spaced-apart lights by the one or more batteries, the control board being enclosed by the first and second housing portions.

11. The lighting system according to claim 1, wherein the at least one wire connector device further comprises a second end portion and a central wire portion disposed between the first end portion and the second end portion.

12. The lighting system according to claim 11, wherein the second end portion of the at least one wire connector device comprises a male electrical connector configured to engage with a female electrical connector disposed on an end of the at least one light bar.

13. The lighting system according to claim 11, wherein the second end portion of the at least one wire connector device comprises a slot disposed therethrough for accommodating a fastener device that attaches the at least one light bar to the one or more frame members of the portable shelter.

14. A lighting system for a portable shelter, comprising:

at least one light bar, the at least one light bar including a plurality of spaced-apart lights;

one or more fastener devices for attaching the at least one light bar to one or more frame members of a portable shelter;

a power module unit, the power module unit configured to provide power to the plurality of spaced-apart lights, the power module unit defining a peripheral wire connector cavity within an interior of the power module unit; and at least one wire connector device for electrically coupling the at least one light bar to the power module unit, the at least one wire connector device including a first end portion, the first end portion of the at least one wire connector device being circumferentially slidable within the peripheral wire connector cavity of the power module unit so as to allow the at least one light bar to be adjustably positioned relative to the power module unit;

wherein the interior of the power module unit comprises a plurality of concentric rail members for supporting the first end portion of the at least one wire connector device.

15. The lighting system according to claim 14, wherein the at least one light bar comprises a plurality of light bars, and wherein the power module unit is configured to be centrally disposed relative to the plurality of light bars.

16. The lighting system according to claim 15, wherein the at least one wire connector device comprises a plurality of wire connector devices, and wherein each of the plurality of light bars is configured to be electrically coupled to the power module unit by a respective one of the plurality of wire connector devices, and each of the plurality of wire connector devices is circumferentially slidable within the peripheral wire connector cavity of the power module unit so as to allow a respective one of the plurality of light bars to be adjustably positioned relative to the power module unit.

17. The lighting system according to claim 14, wherein the at least one wire connector device removably couples the at least one light bar to the power module unit by means of a disengageable electrical connector.

18. The lighting system according to claim 14, wherein the power module unit comprises a first housing portion, a second housing portion, a securement ring, and a battery compartment configured to hold one or more batteries for powering the plurality of spaced-apart lights, the battery compartment being disposed in the second housing portion, the first end portion of the at least one wire connector device being slidably disposed between the securement ring and the plurality of concentric rail members within the power module unit.

* * * * *